US007191792B2

(12) United States Patent
Hendrix

(10) Patent No.: US 7,191,792 B2
(45) Date of Patent: Mar. 20, 2007

(54) COMPRESSOR ASSEMBLY

(75) Inventor: Dean P. Hendrix, Mocksville, NC (US)

(73) Assignee: Ingersoll-Rand Company, Montvale, NJ (US)

( * ) Notice: Subject to any disclaimer, the term of this patent is extended or adjusted under 35 U.S.C. 154(b) by 639 days.

(21) Appl. No.: 10/665,836

(22) Filed: Sep. 19, 2003

(65) Prior Publication Data

US 2005/0063829 A1 Mar. 24, 2005

(51) Int. Cl.
*F16M 5/00* (2006.01)

(52) U.S. Cl. ..... 137/312; 248/346.5; 248/678

(58) Field of Classification Search ..... 137/312, 137/565.17; 248/346.01, 346.5, 671, 678
See application file for complete search history.

(56) References Cited

U.S. PATENT DOCUMENTS

| | | | | |
|---|---|---|---|---|
| 1,553,091 | A * | 9/1925 | McTarnahan | 137/312 |
| 3,859,484 | A | 1/1975 | Nelson | |
| 3,961,868 | A | 6/1976 | Droege, Sr. et al. | |
| 4,033,707 | A | 7/1977 | Stutzman | |
| 4,089,625 | A | 5/1978 | Hofmann, Jr. | |
| 4,275,999 | A | 6/1981 | Hetzel et al. | |
| 4,367,767 | A | 1/1983 | Hurd | |
| 4,522,165 | A | 6/1985 | Ogawa | |
| 4,572,474 | A * | 2/1986 | Derlich | 248/678 |
| 4,938,314 | A | 7/1990 | Sitzler et al. | |
| 5,222,466 | A | 6/1993 | Gratziani | |
| 5,520,519 | A | 5/1996 | Birkeland | |
| 5,531,196 | A | 7/1996 | Clark | |
| 5,613,843 | A | 3/1997 | Isuru et al. | |
| 5,626,468 | A * | 5/1997 | Muir et al. | 248/678 |
| 5,795,136 | A | 8/1998 | Olsaker et al. | |
| 5,873,756 | A | 2/1999 | Takayanagi | |
| 5,964,581 | A | 10/1999 | Iizuka et al. | |
| 6,029,459 | A | 2/2000 | Iizuka et al. | |
| 6,135,726 | A | 10/2000 | Robertson et al. | |
| 6,174,147 | B1 | 1/2001 | Tarutani et al. | |
| 6,520,124 | B2 * | 2/2003 | Bohm, II | 248/678 |

* cited by examiner

*Primary Examiner*—Michael Koczo, Jr.
(74) *Attorney, Agent, or Firm*—Michael Best & Friedrich LLP

(57) ABSTRACT

A compressor assembly having a base. Particularly, a compressor assembly including a base defined at least partially by a support surface and a wall extending upwardly therefrom, an elastomeric coating positioned to cover at least a portion of the base to define a substantially fluid tight containment area, and a fluid compressor positioned within the base with at least a portion of the fluid compressor positioned in the containment area. The present invention may further include a method for assembling a compressor assembly, the method including providing a base having a support surface and a wall extending upwardly therefrom to define a first perimeter, coating at least a portion of the support surface and at least a portion of the wall with an elastomeric material to define a fluid containment area, and positioning at least one fluid compressor component at least partially within the first perimeter.

8 Claims, 4 Drawing Sheets

COMPRESSOR ASSEMBLY

BACKGROUND OF THE INVENTION

The present invention relates to compressor assemblies, and more particularly, to a base assembly for a portable compressor.

Existing compressors or compressor systems can leak oil or other compressor fluids. In many applications, such as snow making or industrial rentals, such leaks can cause potential hazards to personnel and the environment. In an attempt to contain various spills and leaks from the compressors, a portion of the compressor has been fully sealed by welding to create a containment vessel. The compressors have bases that are usually complex structures to which compressor components can be mounted and which provide structural integrity to the compressor assembly to endure loads and stresses associated with transportation and use. Crossbeams, brackets and other compressor mounting structures are welded or bolted together to comprise the base structure. As such, leak-tight welding can be complex, expensive and not always effective.

Alternatively, special containment pads have been constructed on site to contain any leakage from the compressors. Containment pads constructed on site can be completely leak-proof structures or can be comprised of makeshift or temporary structures. The structures are an added cost ranging from expensive, secure and fluid-tight structures to low-cost structures that may not adequately contain a spill or provide containment in the event of a compressor fluid system failure.

SUMMARY OF THE INVENTION

Because compressor bases are usually complex structures formed of a variety of separate crossbeams and brackets that are bolted or welded together, forming a continuous weld seam in the compressor base to fully seal the base can be extremely tedious, time-consuming and expensive. Additionally welding the base structure to fully seal the base can result in warping or other undesirable consequences from over-application of heat to the structural members of the base. A less-than-perfect weld in one area of the base, or a weld that cracks during use, can render the fluid containment properties of the base useless.

Containment pads, if used, may not always be formed of the highest quality and may not be adequate in the event of a compressor fluid system failure. Furthermore, the containment pad used on site for a relatively short period of time, such as in a short-term rental situation or in an emergency, is often not a high quality containment pad.

Many compressor system fluids can be considered hazardous to the environment, and there are many laws regulating the special handling and disposal of compressor system fluids. Properly handling and disposing of spilled compressor system fluids from ineffective containment areas can add additional expense to the user or renter of the compressor.

Therefore, compressors having a reliable fluid containment area that is inexpensive and easy to create would be desirable.

The present invention is generally directed to a compressor assembly comprising a base defined at least partially by a support surface and a wall extending upwardly therefrom, an elastomeric coating positioned to cover at least a portion of the base to define a substantially fluid tight containment area, and a fluid compressor positioned within the base with at least a portion of the fluid compressor positioned in the containment area.

The present invention may be further directed to a base for a compressor assembly, the base comprising a support surface, a wall extending upwardly from the support surface to define a first perimeter, and an elastomeric material positioned to cover at least a portion of the support surface and at least a portion of the wall to define a substantially fluid tight containment area.

The present invention may further include a method for assembling a compressor assembly comprising providing a base having a support surface and a wall extending upwardly therefrom to define a first perimeter, coating at least a portion of the support surface and at least a portion of the wall with an elastomeric material to define a fluid containment area, and positioning at least one fluid compressor component at least partially within the first perimeter.

Other features and aspects of the invention will become apparent to those skilled in the art upon review of the following detailed description, claims, and drawings, wherein like elements have like numerals throughout the drawings.

BRIEF DESCRIPTION OF THE DRAWINGS

The present invention is further described with reference to the accompanying drawings, which show an exemplary embodiment of the present invention, and wherein like numbers represent like elements throughout. However, it should be noted that the invention as disclosed in the accompanying drawings is illustrated by way of example only. The various elements and combinations of elements described below and illustrated in the drawings can be arranged and organized differently to result in embodiments which are still within the spirit and scope of the present invention. Also, it is understood that the phraseology and terminology used herein is for the purpose of description and should not be regarded as limiting. Certain terminology, for example, "top", "bottom", "right", "left", "front", "frontward", "forward", "back", "rear" and "rearward," may be used in the following description for relative descriptive clarity only and is not intended to be limiting.

DETAILED DESCRIPTION

Figure 1:
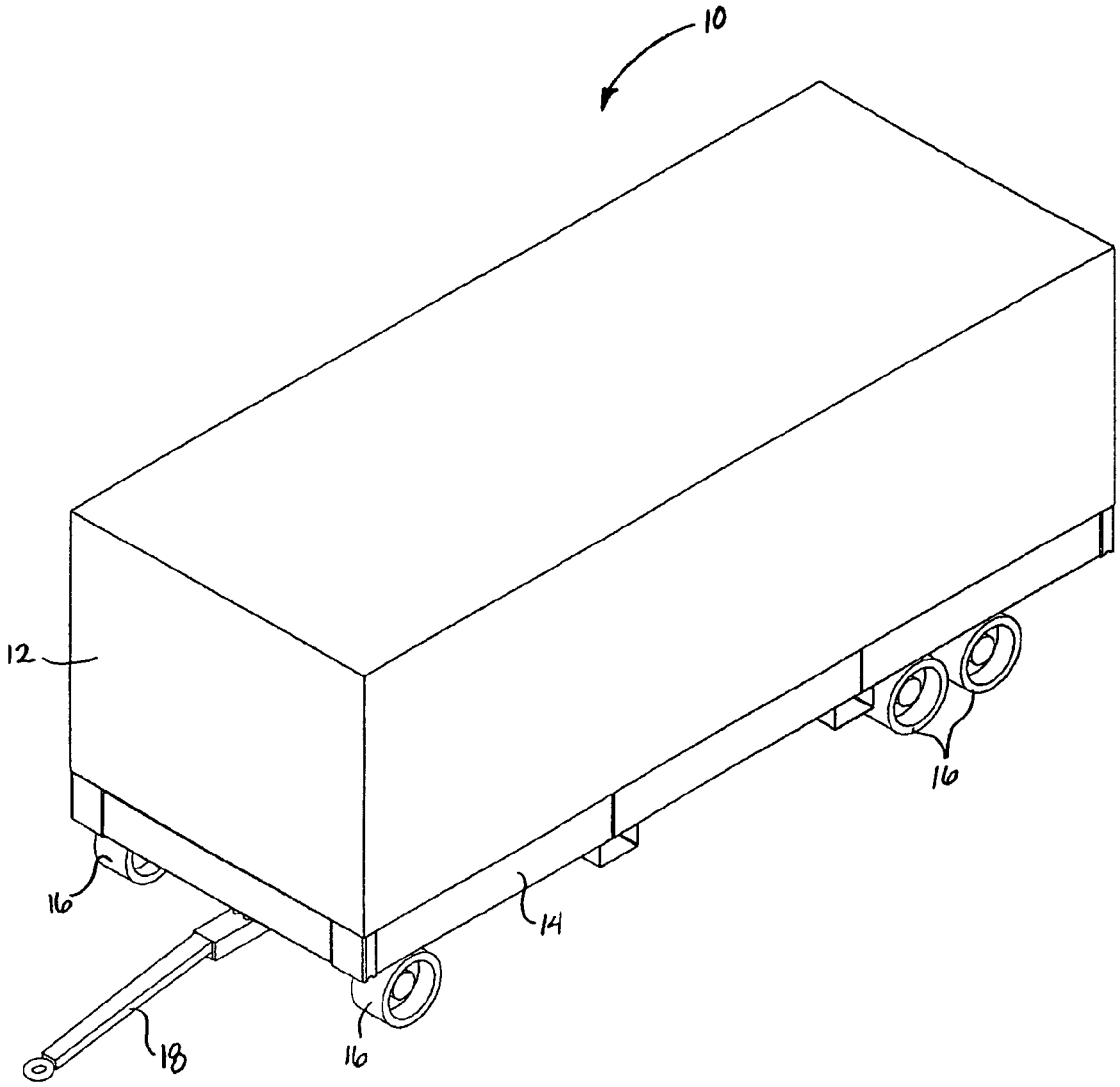
FIG. 1 is a front isometric view of a compressor assembly embodying the present invention, illustrating a cover and a base.

Referring to FIGS. 1–4, and particularly to FIG. 1, a compressor assembly 10 is illustrated and includes a cover 12, a base 14, and wheels 16 and a handle 18 for facile transportation. The illustrated compressor assembly 10 can be used for various applications, for example, snow making or industrial rental applications as described above. The illustrated compressor assembly 10 is for exemplary purposes only, and the present invention can be used with various compressor assemblies without departing from the spirit and scope of the present invention.

Figure 2:
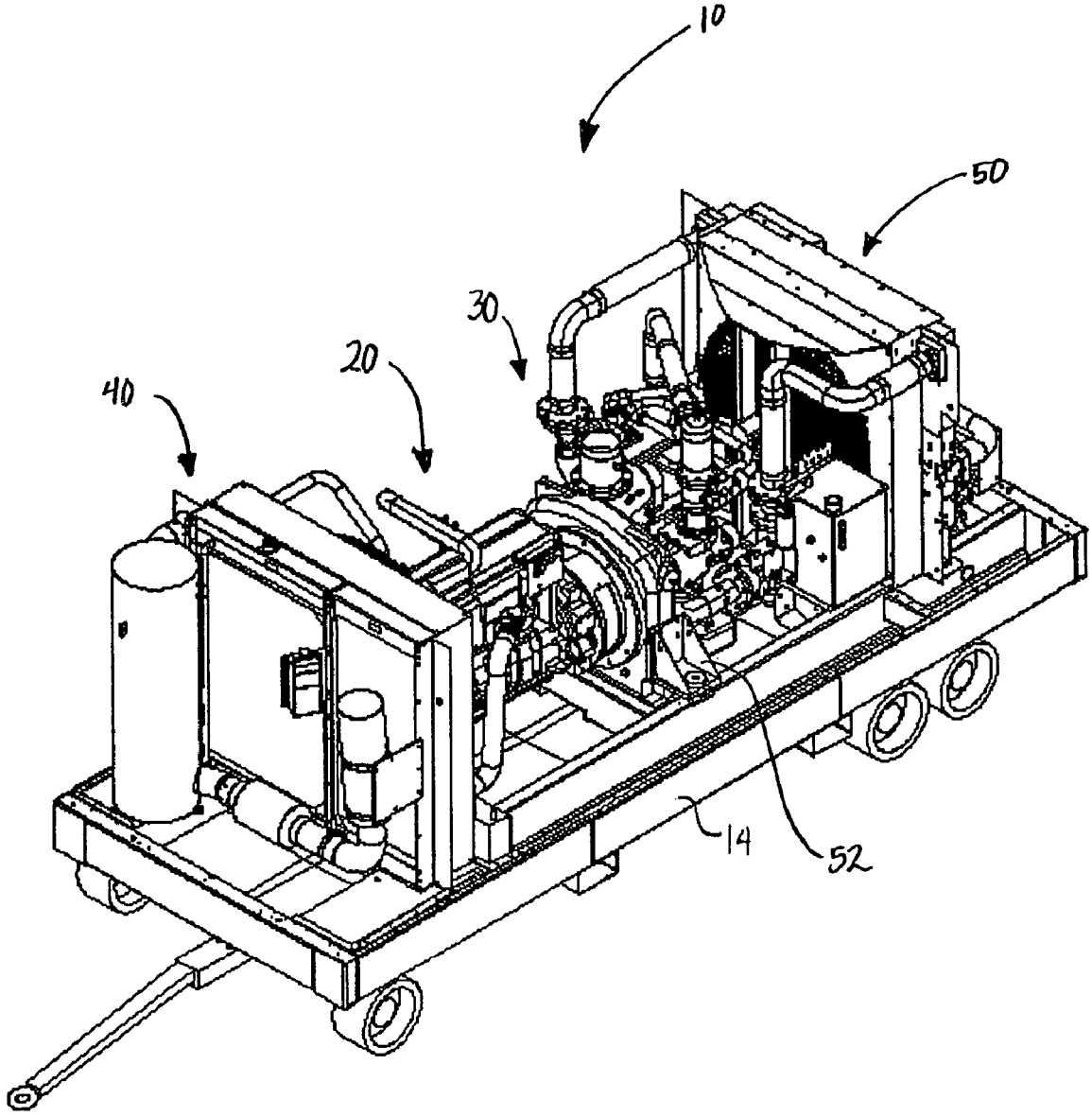
FIG. 2 is a front isometric view of the compressor assembly of FIG. 1 with the cover removed to illustrate subassemblies of the compressor assembly.
Figure 3:
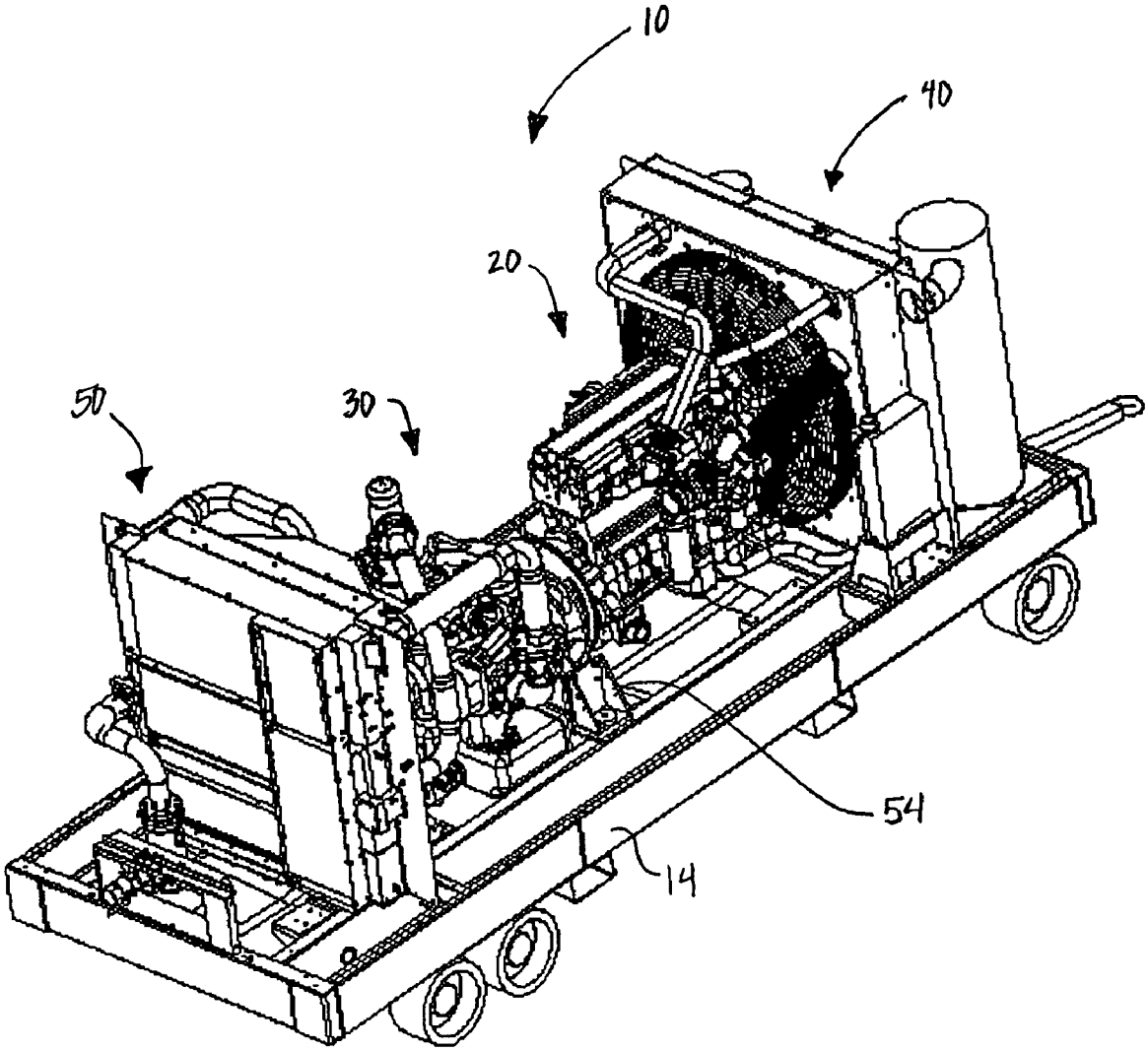
FIG. 3 is a rear isometric view of the compressor assembly of FIG. 1 with the cover removed to illustrate subassemblies of the compressor assembly.

FIGS. 2 and 3 illustrate the compressor assembly 10 of FIG. 1 with the cover 12 removed to reveal various components and subassemblies of the compressor assembly 10. As shown in FIGS. 2 and 3, the compressor assembly 10 includes an engine, motor or power source subassembly, generally indicated at 20. The compressor assembly 10 further includes a compressor subassembly 30, an engine cooling subassembly 40, and a compressor cooling subassembly 50. The power source subassembly 20, the compressor subassembly 30, the engine cooling subassembly 40, and the compressor cooling subassembly 50 together form a fluid compressor. Different arrangements and combinations of fluid compressor subassemblies are possible and within the scope of the present invention. For example, the compressor subassembly 30 may include a rotary screw, centrifugal, or reciprocal compressor, a separator tank, and various oil and fluid filters. Operation of a fluid compressor is well-known to those of ordinary skill in the art, and therefore, only fluid compressor operations and components applicable to the present invention will be discussed herein.

FIGS. 2 and 3 further illustrate how the fluid compressor can be positioned within and atop the base 14. Various bracket and fastener combinations can be used to mount the fluid compressor to the base 14. For example, brackets 52 and 54 are positioned to mount the compressor subassembly 30 to the base 14. Brackets 52 and 54 can be fastened to the compressor subassembly 30, or can alternatively be integrally formed with the compressor subassembly 30, and fastened to a portion of the base 14. Such fastening and mounting devices and structures are well-known to those of ordinary skill in the art and are therefore not discussed in greater detail herein. Other brackets and mounting devices can be used to mount other fluid compressor subassemblies to the base 14.

Figure 4:
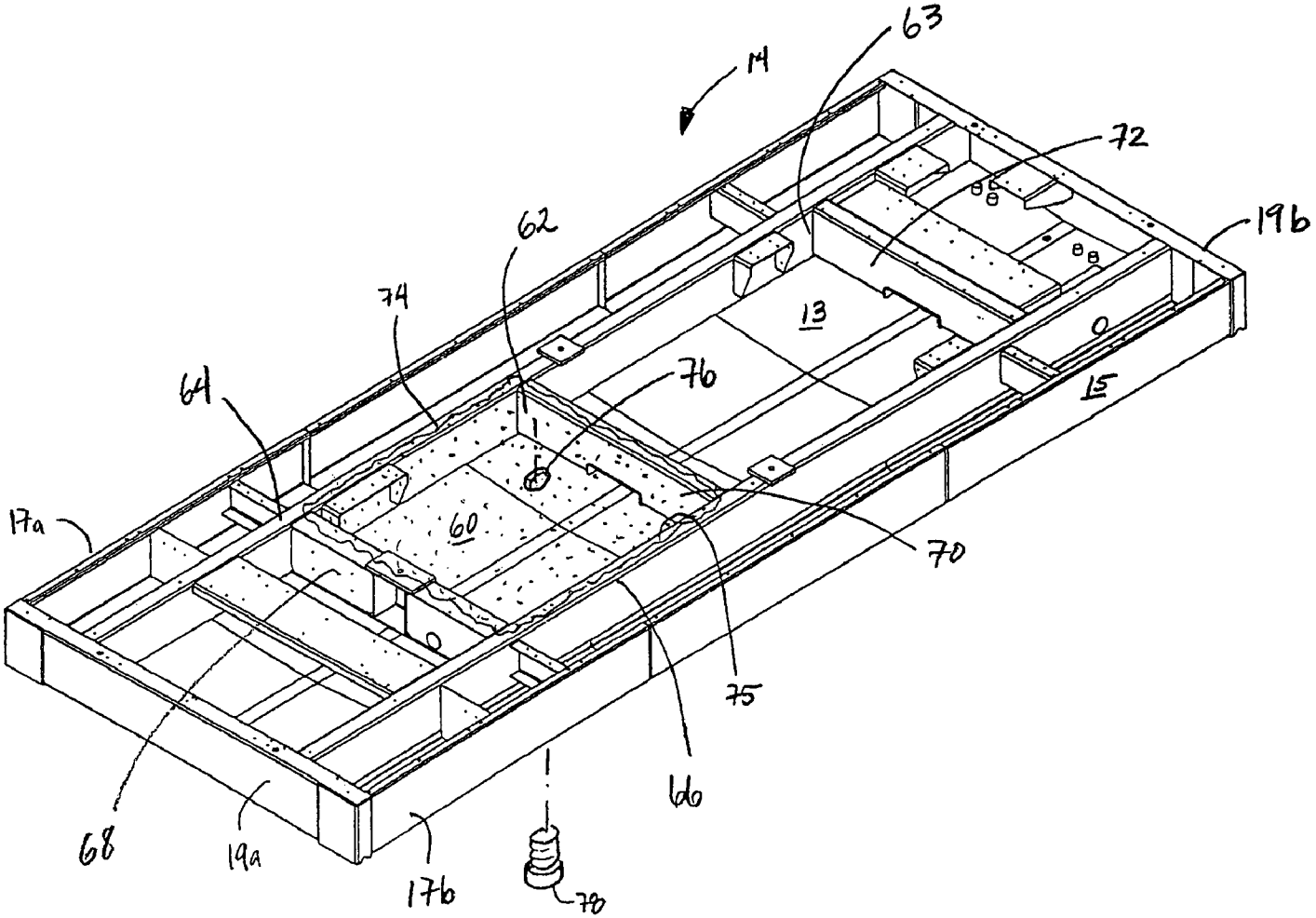
FIG. 4 is an isometric view of the base of FIG. 1.

FIG. 4 illustrates the base 14. As illustrated in FIG. 4, the base 14 has a somewhat complex structure formed of various brackets, beams, bars, and the like. The base 14 has two long sides 17*a* and 17*b*, and two short sides 19*a* and 19*b*. The base 14 defines a general longitudinal direction parallel to the long sides 17*a* and 17*b*, and a general lateral or transverse direction parallel to the short sides 19*a* and 19*b* and perpendicular to the longitudinal direction. The illustrated base 14 has an interior surface 13 and an exterior surface 15. The base 14 comprises a support surface 60 that forms a portion of the interior surface 13, and a first wall 62 extending upwardly from the support surface 60 to define a first perimeter. The first wall 62, and hence the first perimeter, is formed by a portion of a first longitudinally-extending beam 64, a portion of a second longitudinally-extending beam 66, a first laterally-extending beam 68 and a second laterally-extending beam 70. The first and second laterally-extending beams 68, 70 are positioned to connect the first and second longitudinally-extending beams 64, 66 to form the first perimeter. It will be readily understood by those of ordinary skill in the art that the base 14 does not necessarily have to be positioned at the bottom of the compressor assembly 10, but that the base 14 can be configured differently to provide a support structure to the compressor assembly 10 while providing surfaces that can at least partially form a fluid containment area.

The first wall 62 can be integrally formed with the support surface 60, or the first wall 62 can be welded or otherwise fastened to the support surface 60. The support surface 60 can itself define a second perimeter. The first perimeter and the second perimeter can be substantially equal, or the second perimeter can be larger than the first perimeter. The base 14 can have a plurality of perimeters, each perimeter defined by a wall that extends upwardly from the support surface 60, similar to the first wall 62. For example, the first longitudinally-extending beam 64, the second longitudinally-extending beam 66, and the second laterally-extending beam 70 form a portion of a second wall 63, that is further formed by a third laterally-extending beam 72 to form a third perimeter.

The total area contained within perimeters formed by walls can be equal to the area contained within the second perimeter formed by the support surface 60. Alternatively, a portion of the support surface 60 can be free of walls, and the total area contained within the perimeters formed by walls can hence be smaller than the area contained within the second perimeter. The walls of the base 14 can be formed by beams, bars, plates, rods, and the like. Various arrangements of walls can be used to create mounting and support sites within the base 14 for the fluid compressor.

An elastomeric material or coating 74 is positioned to cover the support surface 60 and a portion of the first wall 62, thereby defining a substantially fluid tight containment area 75. As mentioned above, the various beams and support structures of the base 14 are typically welded or otherwise fastened together, and continuous welds, which are expensive, tedious and time-consuming, are applied to fluidly seal the base 14. In the illustrated embodiment, the elastomeric material 74 removes the need to apply continuous welds for fluidly sealing the base 14. Instead, the elastomeric material 74 provides an effective substantially fluid tight containment area 75 without the expense or time required to produce effectively welded fluid containment areas.

The elastomeric material 74 can be applied evenly to the entire base 14, or it can be preferentially applied to certain regions or areas of the base 14. For example, the elastomeric material 74 illustrated in FIG. 4 covers surfaces defined by the support surface 60 and the first wall 62 within the first perimeter and provides a substantially fluid tight containment area 75 that is defined by the first perimeter. Based on the arrangement and position of the fluid compressor within the base 14, and the subassemblies associated therewith, the elastomeric material 74 can be applied to specific regions of the base 14 based on need. That is, the elastomeric material 74 can be spot-applied to any interior or exterior region of the base 14 to provide a substantially fluid tight containment area, and need not be continuously applied within an entire perimeter.

The elastomeric material 74 can be continuously applied to the entire interior surface 13 of the base 14, the entire exterior surface 15 of the base 14, or combinations thereof. When the exterior surface 15 of the base 14 is at least partially covered with the elastomeric material 74, the elastomeric material 74 can provide a flexible and crack-resistant protection barrier to the base 14, in addition to providing a substantially fluid tight containment area. The flexible and crack-resistant protection barrier would be particularly useful for compressor assemblies used in industrial rental applications to protect the compressor assembly from damage during transportation.

The elastomeric material 74 can be formed of a variety of materials, and particularly, can be formed of a material that is resistant to chemical erosion or attack. For example, the elastomeric material 74 can comprise at least one of rubber, polybutadiene, polyurethane, ethylene propylene rubber, silicone rubber, and combinations thereof.

The elastomeric material 74 can be applied to the base 14 by a variety of methods, including at least one of spraying, dipping, brushing on, combinations thereof, and a variety of other methods known to those of ordinary skill in the art to provide an adequate substantially fluid tight seal in the base 14.

The elastomeric material 74 can be applied to the base 14 to a variety of thicknesses, depending on the desired sealing characteristics, the method of application, the type of elastomeric material 74 used, and whether the elastomeric material 74 will also be intended to act as a protective barrier to the compressor assembly 10. For example, in some embodiments of the present invention, a thin layer of elastomeric material 74 ranging in thickness from 1/16" to 1/2" can be applied by brushing on the elastomeric material or by other application methods. Alternatively, in other embodiments of the present invention, the thickness of the elastomeric material 74 can range from 1/16" to 1/4" . In still other embodiments, the thickness of the elastomeric material 74 can range from 1/16" to 1/8" . Still, other thicknesses are possible and within the spirit and scope of the present invention.

The elastomeric material 74 provides a more flexible seal than existing seals commonly-known to those of ordinary skill in the art. The flexible seals created by the elastomeric material 74 are better able to withstand reasonable deformations without cracking or allowing fluid to leak from the base 14. Furthermore, if the elastomeric material 74 is used to coat the exterior surface 15 of the base 14, the elastomeric material 74 can be used as an exterior finish for the compressor assembly 10, thereby at least partly eliminating the need to paint or otherwise finish the exterior surface 15 of the base 14. If any repairs are needed over time, repairing or reapplying the elastomeric material 74 will be simpler, faster and cheaper than repairing existing seals, such as continuous welds.

The substantially fluid tight containment area 75 also includes a sealable aperture 76 to allow removal of fluid from the substantially fluid tight containment area. FIG. 4 further illustrates a plug 78 dimensioned to be removably received in the aperture 76. Alternatively, the sealable aperture 76 can be in fluid communication with a valve that can be actively or passively controlled. The aperture 76 extends through the support surface 60 and through the elastomeric material 74. The aperture 76 is preferably positioned adjacent a low point of the base such that fluid in the containment area 75 drains toward the aperture 76. Alternatively, the aperture 76 can be positioned in a portion of the first wall 62 to provide a safety escape for fluid once it reaches a predetermined level in the substantially fluid tight containment area 75.

A fluid level sensor 80 may be positioned in the fluid tight containment area 75. The fluid level sensor 80 may be a float type, differential pressure transmitter, sight glass or any other fluid level sensing means. The fluid level sensor 80 is preferably configured to provide a visual or audible signal when fluid in the containment area 75 reaches a predetermined level. The signal allows an operator to identify if the compressor assembly 10 is leaking excessively and also alerts the operator to drain fluid from the containment area 75 prior to overflow.

What is claimed is:

1. A compressor assembly comprising:

a base defined at least partially by a support surface and a wall extending upwardly therefrom;

an elastomeric coating positioned to cover at least a portion of the base to define a substantially fluid tight containment area; and a fluid compressor positioned within the base with at least a portion of the fluid compressor position in the containment area.

2. The compressor assembly as set forth in claim 1, wherein the wall defines a substantially er closed perimeter.

3. The compressor assembly as set forth in claim 2, wherein the substantially enclosed perimeter supports the elastomeric coating to define the fluid containment area.

4. The compressor assembly as set forth in claim 1, wherein at least one of the support surface and the wall define a mounting surface for at least a portion of the fluid compressor.

5. The compressor assembly as set forth in claim 1, further comprising a sealable aperture in the fluid containment area.

6. The compressor assembly as set forth in claim 5, further comprising a valve in fluid communication with the aperture to allow selective fluid removal.

7. The compressor assembly as set forth in claim 1, further comprising a fluid level sensor positioned in the fluid containment area to sense fluid level.

8. The compressor assembly as set forth in claim 1, wherein the elastomeric coating comprises at least one of natural rubber, polyurethane, polybutadiene, silicone rubber, ethylene propylene rubber, and a combination thereof.

* * * * *

UNITED STATES PATENT AND TRADEMARK OFFICE

CERTIFICATE OF CORRECTION

PATENT NO. : 7,191,792 B2
APPLICATION NO. : 10/665836
DATED : March 20, 2007
INVENTOR(S) : Dean P. Hendrix It is certified that error appears in the above-identified patent and that said Letters Patent is hereby corrected as shown below:

Claim 2, col. 6, replace “er closed” with --enclosed--.

Signed and Sealed this

Seventh Day of August, 2007

JON W. DUDAS
*Director of the United States Patent and Trademark Office*